US007104432B2

(12) United States Patent
Sun

(10) Patent No.: US 7,104,432 B2
(45) Date of Patent: Sep. 12, 2006

(54) TRANSMISSION MECHANISM OF ELECTRIC NAILING GUN

(75) Inventor: Pei-Chang Sun, 5Fl., No. 3, Alley 2, Lane 151, Sec. 1, Chungde 6th Rd., Beituen Chiu, Taichung (TW) 406

(73) Assignees: An Puu Hsin Co., Ltd., (TW); Pei-Chang Sun, (TW)

( * ) Notice: Subject to any disclaimer, the term of this patent is extended or adjusted under 35 U.S.C. 154(b) by 0 days.

(21) Appl. No.: 10/913,416

(22) Filed: Aug. 9, 2004

(65) Prior Publication Data

US 2006/0027622 A1 Feb. 9, 2006

(51) Int. Cl.
*B25C 1/00* (2006.01)

(52) U.S. Cl. ..... 227/132; 227/129; 227/131; 173/124; 173/203

(58) Field of Classification Search ..... 227/147, 227/120, 129, 133, 139, 141, 8, 131, 132; 173/216, 124, 203
See application file for complete search history.

(56) References Cited

U.S. PATENT DOCUMENTS

| | | | | |
|---|---|---|---|---|
| 4,066,136 | A * | 1/1978 | Wanner et al. | 173/48 |
| 4,530,454 | A * | 7/1985 | Gloor et al. | 227/129 |
| 4,583,600 | A * | 4/1986 | Smith, III | 173/124 |
| 4,811,885 | A * | 3/1989 | Lai | 227/131 |
| 5,118,023 | A * | 6/1992 | Fushiya et al. | 227/8 |
| 5,720,423 | A * | 2/1998 | Kondo et al. | 227/130 |
| 6,705,503 | B1 * | 3/2004 | Pedicini et al. | 227/131 |
| 6,820,787 | B1 * | 11/2004 | Pinczewski et al. | 227/5 |
| 6,899,260 | B1 * | 5/2005 | Sun | 227/132 |

* cited by examiner

*Primary Examiner*—Scott A. Smith
*Assistant Examiner*—Brian Nash
(74) *Attorney, Agent, or Firm*—Bacon & Thomas PLLC

(57) ABSTRACT

A transmission mechanism for an electric nailing gun includes a motor, a driving wheel connected to an output shaft of the motor and having an eccentric rod, and a wear-resistant ring rotatably mounted on the eccentric rod for enabling the eccentric rod to push a slide of a nail striking mechanism of the electric nailing gun without producing much friction during rotation of the driving wheel along with the output shaft of the motor.

1 Claim, 6 Drawing Sheets

TRANSMISSION MECHANISM OF ELECTRIC NAILING GUN

BACKGROUND OF THE INVENTION

1. Field of the Invention

The present invention relates to electric nailing guns, and more particularly to a transmission mechanism for use in an electric nailing gun.

2. Description of the Related Art

FIGS. 8 and 9 show a transmission mechanism 80 of a conventional electric nailing gun for striking nails. The transmission mechanism 80 is comprised of a motor (not shown), a gear wheel 81 driven for rotation by the motor and having two lugs 82 and 83 eccentrically provided at one side, and a linearly movable slide 84. The slide 84 is held in a position inside a housing of the electric nailing gun when a plunger spring is compressed. Further, the slide 84 has an upper block 841 and a lower block 842 respectively corresponding to the lugs 82 and 83 of the gear wheel 81. During rotation of the gear wheel 81, the lugs 82 and 83 are moved with the gear wheel 81 to respectively push the upper block 841 and lower block 842 of the slide 84 to move the slide 84 upwards, thereby enhancing stroke of the plunger and the nail impact force. However, because the lugs 82 and 83 are moved to push the upper and lower blocks 841 and 842 of the slide 84 directly, the upper and lower blocks 841 and 842 wear quickly under a long time of use.

Therefore, it is desirable to provide an improved transmission mechanism for the electric nailing gun to eliminate the aforesaid problem.

SUMMARY OF THE INVENTION

The present invention has been accomplished under the circumstances in view. It is the main object of the present invention to provide a transmission mechanism, which prolongs the service life of an electric nailing gun and maintains stability and effectiveness of striking nails.

To achieve the foregoing object of the present invention, the transmission mechanism for the electric nailing gun, which is comprised of a housing having a receiving chamber and an actuation chamber, and a nail striking mechanism mounted in the actuation chamber of the housing and having a slide movable between an upper limit position and a lower limit position and a push member for pushing and holding the slide in the upper limit position, is comprised of a motor mounted in the receiving chamber inside the housing and having an output shaft, and a driving wheel coupled to and rotatable with the output shaft of the motor. The driving wheel has a face facing the actuation chamber and an eccentric rod eccentrically disposed on the face. The transmission mechanism further includes a wear-resistant ring rotatably mounted on the eccentric rod of the driving wheel to enable the eccentric rod of the driving wheel to push the slide from the upper limit position toward the lower limit position during the rotation of the driving wheel.

DETAILED DESCRIPTION OF THE INVENTION

Figure 1:
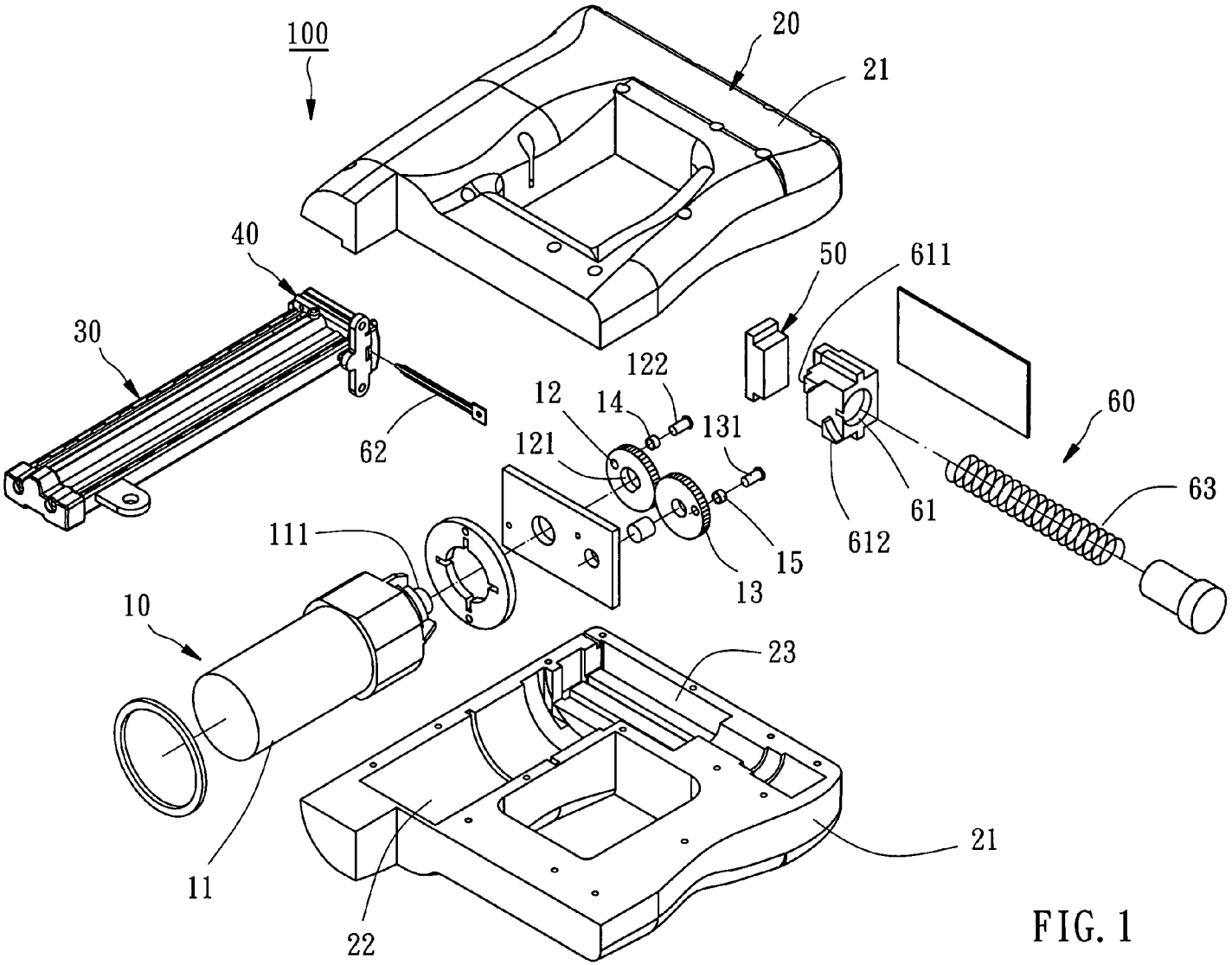
FIG. 1 is an exploded view of an electric nailing gun constructed according to a first preferred embodiment of the present invention.
Figure 2:
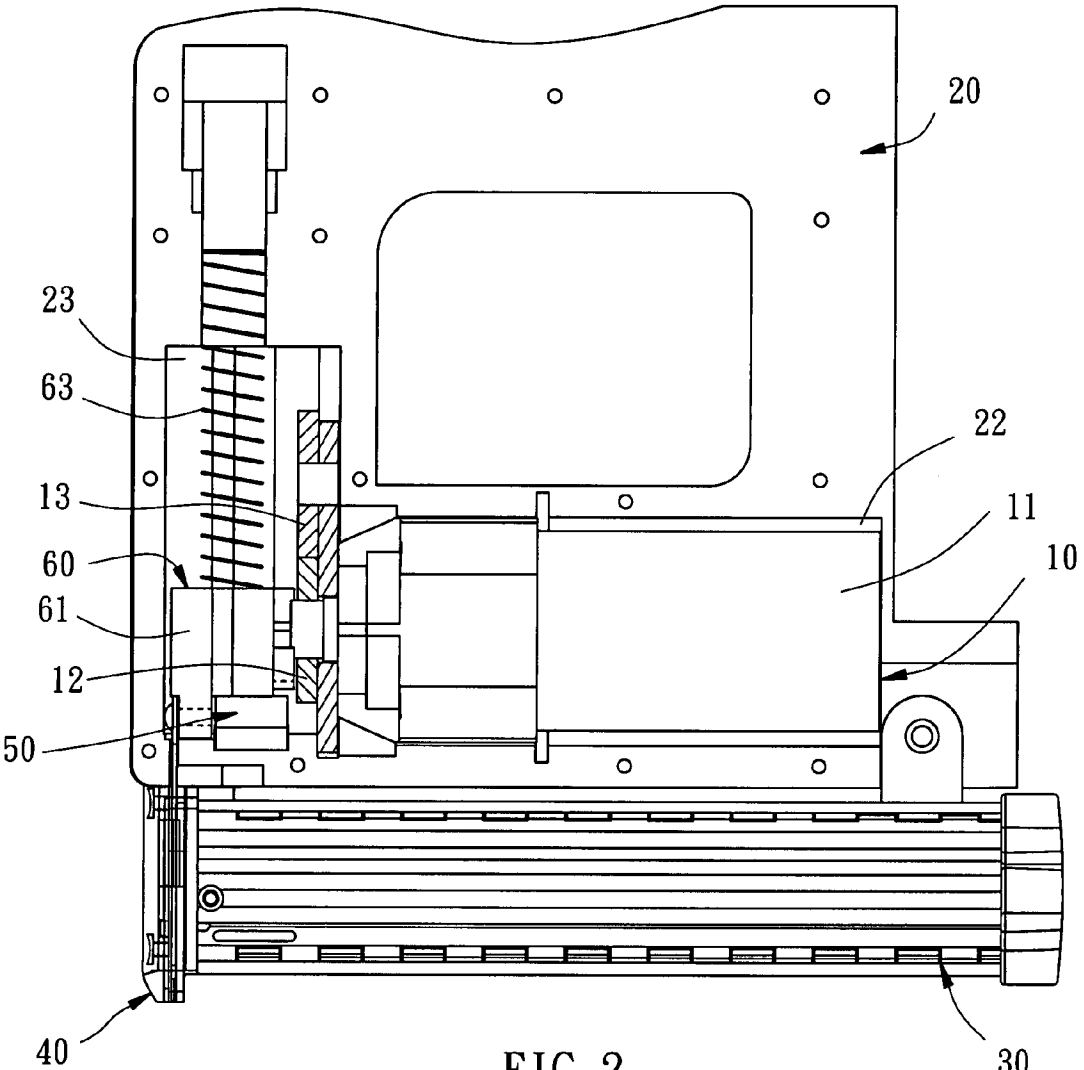
FIG. 2 is a sectional view of the electric nailing gun according to the first preferred embodiment of the present invention.
Figure 6:
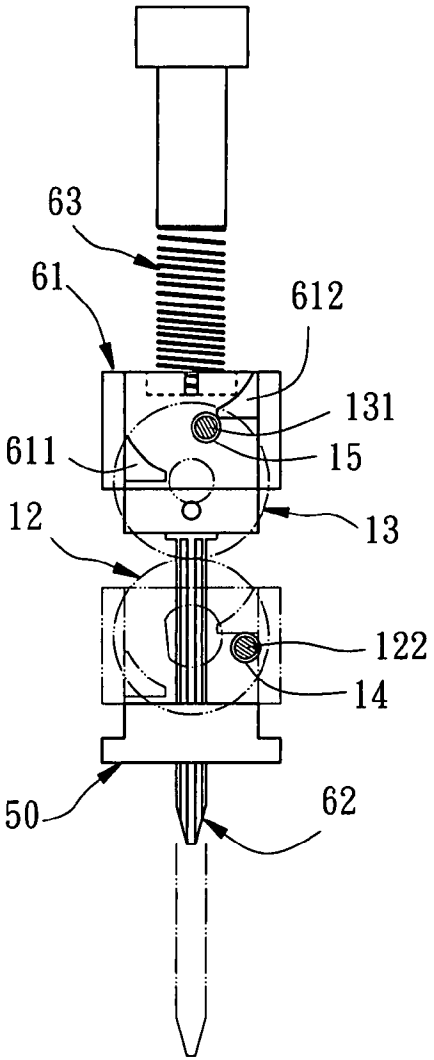
FIGS. 4–6 show the transmission mechanism of the first preferred embodiment of the present invention at work.

Referring to FIGS. 1 and 2, an electric nailing gun 100 is comprised of a housing 20, a nail magazine 30, a nail outlet 40, a buffer block 50, a nail striking mechanism 60, and a transmission mechanism 10.

Figure 3:
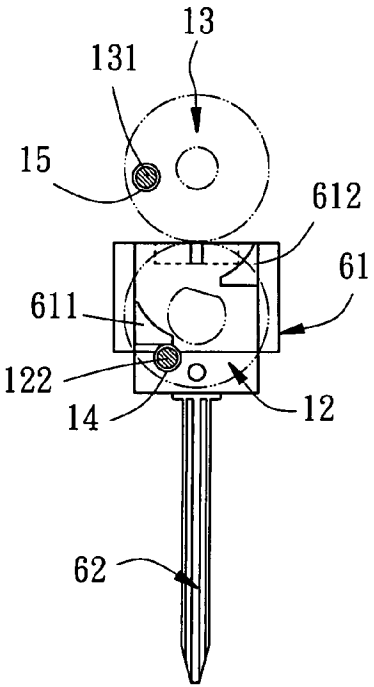
FIG. 3 is a schematic view of a part of the electric nailing gun according to the first preferred embodiment of the present invention.

The housing 20 is formed of two symmetrical cover shells 21 fastened to each other, defining therein a receiving chamber 22 and an actuation chamber 23 in communication with the receiving chamber 22. The nail magazine 30 is fastened to an outer side of the housing 20 for holding nails (not shown). The nail outlet 40 is connected to an end of the nail magazine 30, corresponding to an outer end of the actuation chamber 23. The buffer block 50 is mounted inside the actuation chamber 23, abutting the nail outlet 40. The nail striking mechanism 60 is mounted inside the actuation chamber 23, having a slide 61, a plunger 62, and a push member 63. The slide 61 is reciprocatingly movable in the actuation chamber 23 between an upper limit position (see FIG. 3) and a lower limit position (see FIG. 5), having an upper block 611 and a lower block 612. The plunger 62 has a rear end connected to the slide 61. The push member 63 is a plunger spring stopped between an inside wall of the actuation chamber 23 and the slide 61 to hold the slide 61 in the aforesaid upper limit position.

The transmission mechanism 10 constructed according to a first preferred embodiment of the present invention is mounted inside the receiving chamber 22 of the housing 20, including a motor 11, a driving wheel 12, a driven wheel 13, and two rings 14 and 15. The motor 11 has an output shaft 111 provided with a non-circular cross-section. The driving wheel 12 according to this preferred embodiment is a gear having a non-circular through hole 121 coupled to the output shaft 111 of the motor 11, and a first eccentric rod 122 extending into the actuation chamber 23. The driven wheel 13 according to this preferred embodiment is a gear meshed with the driving wheel 12, having a second eccentric rod 131 extending into the actuation chamber 23. The two rings 14 and 15 are made of wear-resistant metallic material respectively rotatably fitted to the first and second eccentric rods 122 and 131. During rotation of the driving wheel 12 and the driven wheel 13, the first and second eccentric rods 122 and 131 are moved to alternately push the upper block 611 and lower block 612 of the slide 61.

Figure 5:
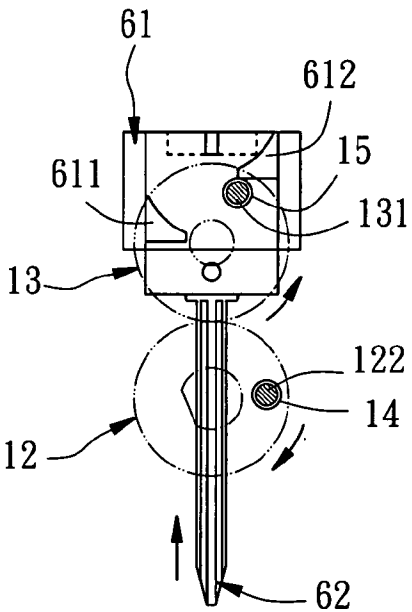
Figure 4:
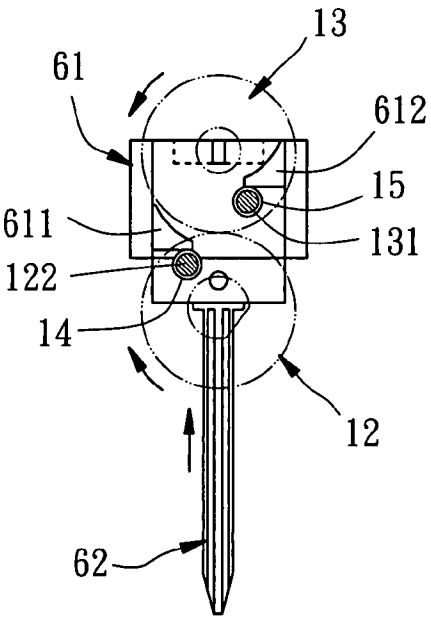

Referring to FIGS. 3–6, when the electric nailing gun 100 is operated, the motor 11 is started to drive the driving wheel 12 to rotate. Meanwhile, the wear-resistant metal ring 14 is moved with the eccentric rod 122 of the driving wheel 12 to contact against the upper block 611 of the slide 61, thereby pushing the slide 61 away from the upper limit position (see FIG. 3). During down stroke of the slide 61, the wear-resistant metal ring 15 is moved with the eccentric rod 131 of the driven wheel 13 to contact against the lower block 612 of the slide 61 (see FIG. 4). Thereafter, as shown in FIG. 5, the wear-resistant metal ring 14 is moved with the eccentric rod 122 of the driving wheel 12 away from the upper block 611 of the slide 61, and the wear-resistant metal ring 15 is forced to push the lower block 612 of the slide 61, thereby moving the slide 61 to the lower limit position. As soon as the wear-resistant metal ring 15 disengages from the lower block 612 of the slide 61, the push member (plunger spring) 63 pushes the slide 61 and the plunger 62 toward the nail outlet 40 in a rush. When the slide 61 touches the buffer block 50, one cycle of striking a nail is finished. When the wear-resistant metal ring 14 or 15 touches the slide 61, the friction force between the wear-resistant metal ring 14 or 15 and the slide 61 causes the wear-resistant metal ring 14 or 15 to rotate on the respective eccentric rod 122 or 131 relative to the slide 61, thereby reducing the potential wear incurred between the eccentric rods 122 and 131 and the slide 61. Therefore, the invention greatly prolongs the service life of the electric nailing gun.

Figure 7:
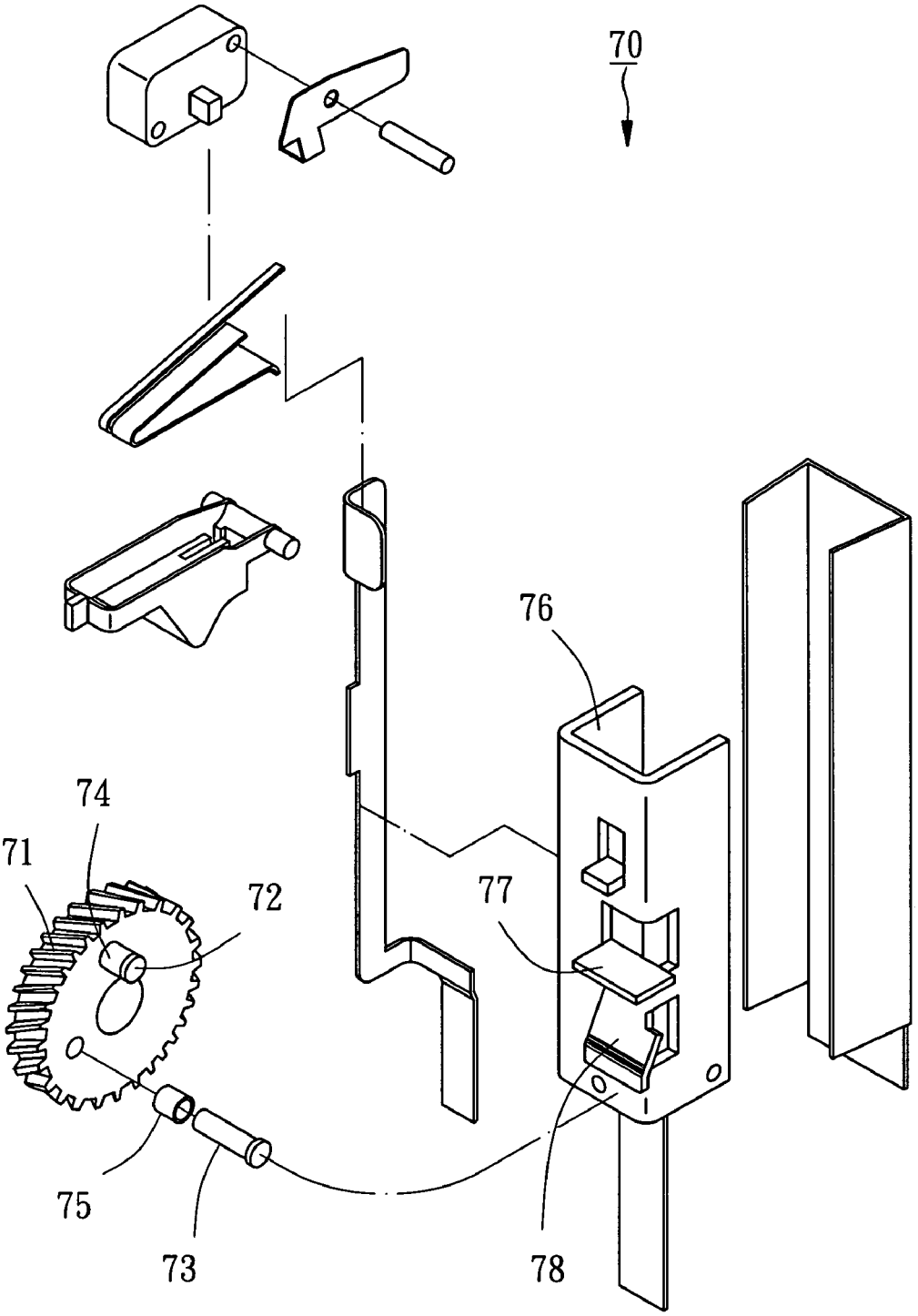
FIG. 7 is a partial exploded view of a second preferred embodiment of the present invention.
Figure 8:
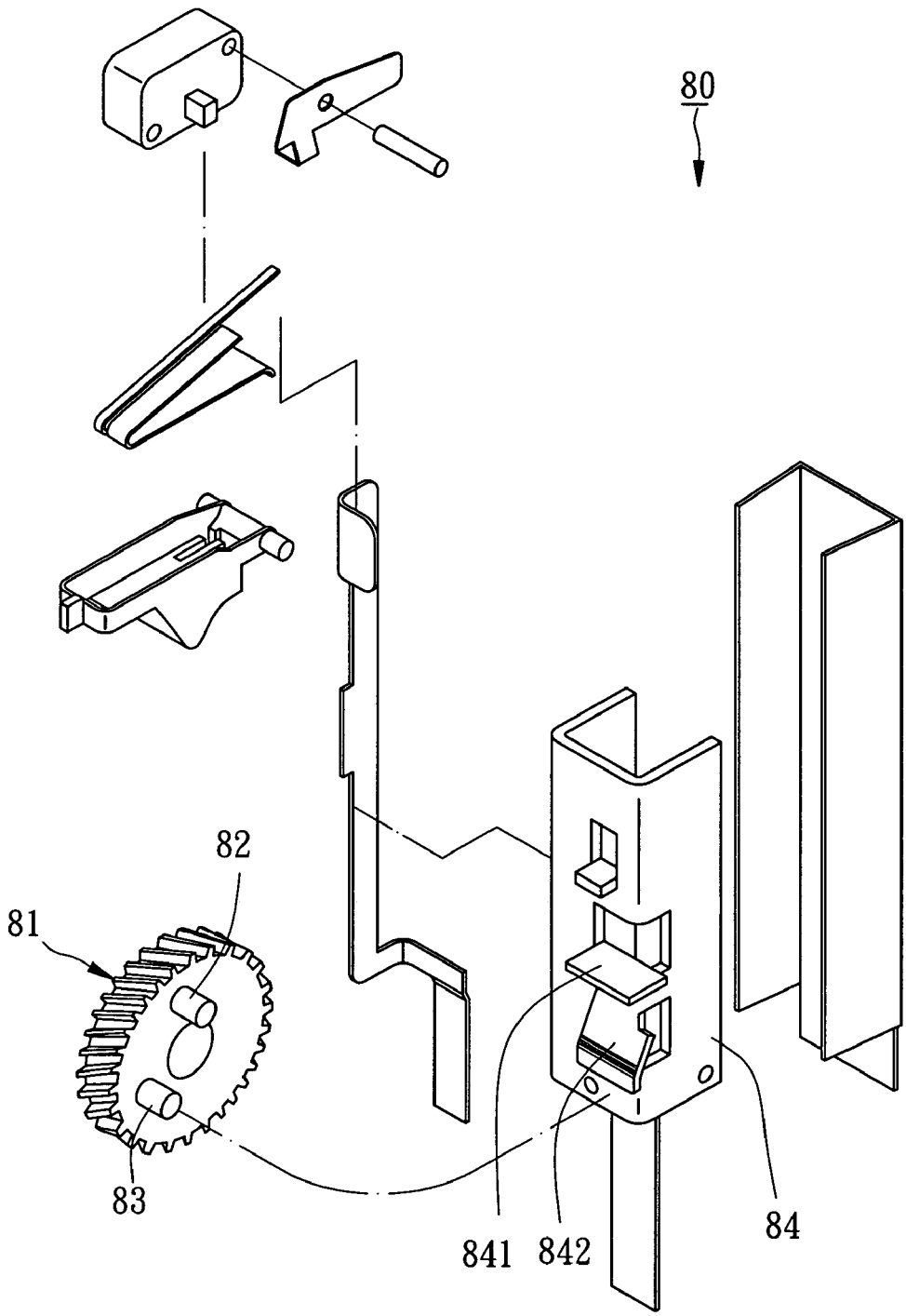
FIG. 8 PRIOR ART
FIG. 8 is a partial exploded view of the prior art.
Figure 9:
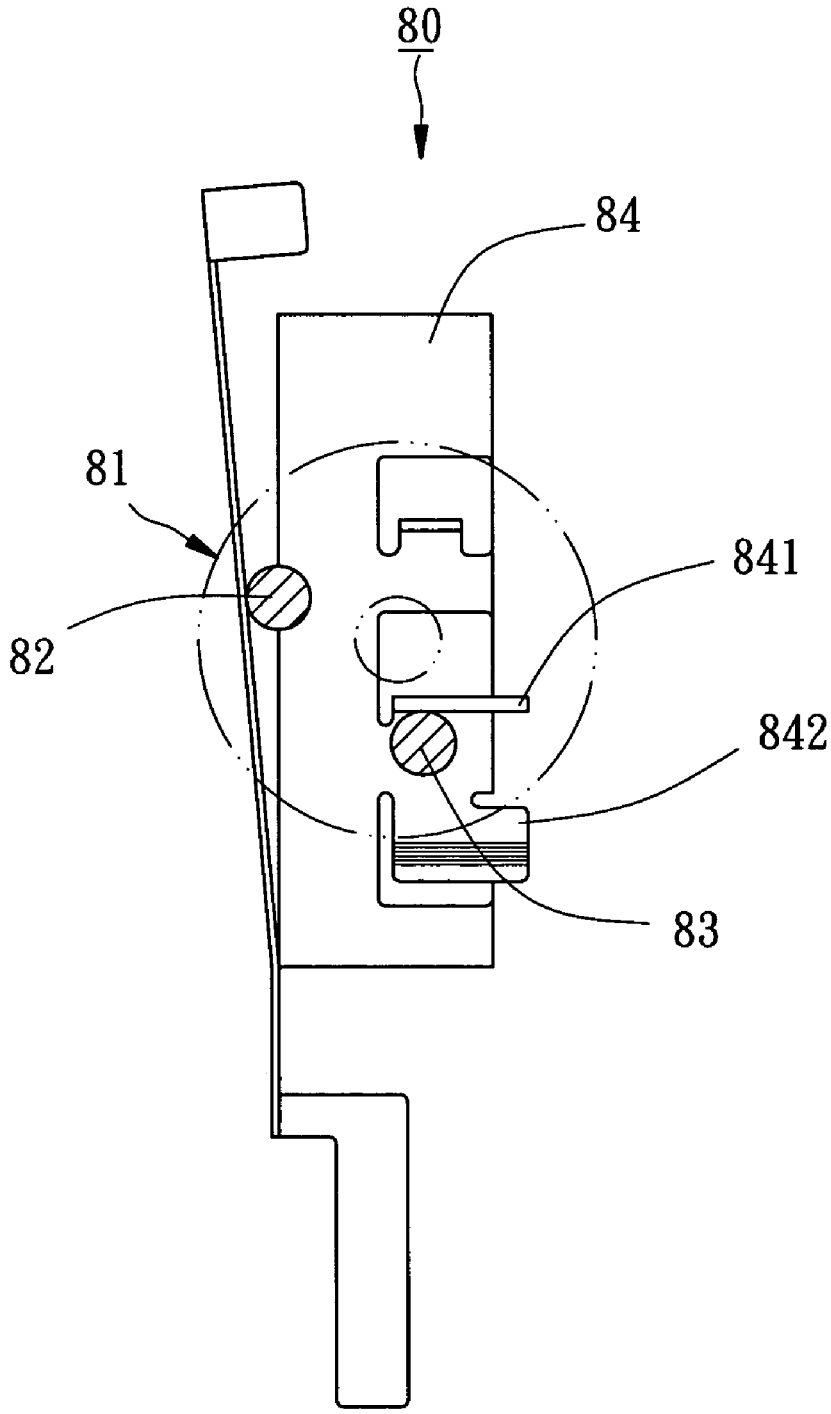
FIG. 9 PRIOR ART
FIG. 9 is a schematic view of the prior art at work.

Referring to FIG. 7, the transmission mechanism 70 constructed according to a second preferred embodiment of the present invention is similar to the first preferred embodiment, but excluding the driven wheel. The transmission mechanism 70 is mounted in the electric nailing gun 110, including a motor (not shown), a driving wheel 71 having two eccentric rods 72 and 73, and two wear-resistant metal rings 74 and 75 respectively mounted on the eccentric rods 72 and 73. During rotation of the driving wheel 71, the wear-resistant metal rings 74 and 75 are respectively moved with the eccentric rods 72 and 73 to alternately push the upper block 77 and lower block 78 of the slide 76. Because the slide 76 is pushed twice alternately by the wear-resistant metal rings 74 and 75, the stroke of the slide 76 is greatly enhanced.

What is claimed is:

1. A transmission mechanism for an electric nailing gun, said electric nailing gun having a housing and a nail striking mechanism, said housing having a receiving chamber and an actuation chamber, said nail striking mechanism having a slide and a push member respectively mounted in said actuation chamber, said slide being reciprocatingly movable between an upper limit position and a lower limit position, said push member being movable for pushing said slide and holding said slide in said upper limit position, said transmission mechanism comprising:

a motor mounted in said receiving chamber of said housing and having an output shaft; and a driving wheel connected to and rotatable with the output shaft of said motor, said driving wheel having a face facing said actuation chamber, a first eccentric rod eccentrically located on said face, and a first wear-resistant ring rotatably mounted on said first eccentric rod for enabling said first eccentric rod to push said slide from said upper limit position toward said lower limit position during the rotation of said driving wheel;

wherein said driving wheel is a gear; said transmission mechanism further comprises a gear-like driven wheel mounted inside said receiving chamber of said housing and meshed with said driving wheel, said driven wheel having a face facing said actuation chamber and a second eccentric rod eccentrically located on said face, and a second wear-resistant ring rotatably mounted on said second eccentric rod for enabling said second eccentric rod to continue pushing said slide to move after said first eccentric rod stops pushing and moves away from said slide.

* * * * *